US005234079A

United States Patent [19]

Nomura

[11] Patent Number: 5,234,079

[45] Date of Patent: Aug. 10, 1993

[54] ROPELESS LINEAR MOTOR ELEVATOR SYSTEM

[75] Inventor: Masami Nomura, Inazawa, Japan

[73] Assignee: Mitsubishi Denki Kabushiki Kaisha, Tokyo, Japan

[21] Appl. No.: 788,238

[22] Filed: Nov. 5, 1991

[30] Foreign Application Priority Data

Nov. 6, 1990 [JP] Japan ..... 2-298831

[51] Int. Cl.[5] ..... B66B 5/16

[52] U.S. Cl. ..... 187/80; 187/112

[58] Field of Search ..... 187/112, 73, 89, 91, 187/80, 77

[56] References Cited

FOREIGN PATENT DOCUMENTS 62-136476 8/1987 Japan .

0003875 1/1991 Japan ..... 187/112

*Primary Examiner*—Robert P. Olszewski

*Assistant Examiner*—Kenneth Noland

*Attorney, Agent, or Firm*—Leydig, Voit & Mayer

[57] ABSTRACT

A ropeless linear motor elevator system includes linear motor coils disposed along a guide rail for guiding an elevator car. A linear motor propulsion unit (14) including an operating bar movable relative to the car is mounted on the car for generating a car propulsion force in cooperation with the linear motor coils. The elevator car has mounted thereon a brake unit including a brake shoe engageable with the rail to stop the car and biasing member for urging the brake shoe toward the rail. The operating bar of the propulsion unit is movable between a first position in which the brake shoe engages the rail against the action of the biasing member and a second position in which the brake shoe is released from the rail by the action of the biasing member in response to a propulsion force acting on the propulsion unit.

3 Claims, 4 Drawing Sheets

ROPELESS LINEAR MOTOR ELEVATOR SYSTEM

BACKGROUND OF THE INVENTION

This invention relates to a ropeless linear motor elevator system in which an elevator car can be vertically moved within a hoistway by a propulsion force of a linear motor without using a rope.

FIG. 4 is a schematic diagram illustrating a conventional ropeless linear motor elevator system similar to that disclosed in Japanese Utility Model Laid-Open No. 62-136476.

In the figure, a plurality of coils (2) are disposed in vertical arrays and vertically extending rails (3) are mounted on each side wall of a hoistway (1). On each side of an elevator car (4) which moves up and down along the rails (3) within the hoistway (1), a plurality of permanent magnets (5) are mounted in opposition to the coils (2).

In the conventional ropeless linear motor elevator system as described above, the coils (2) and the permanent magnets (5) constitute a synchronous linear motor, which generates a linear motor propulsion force for vertically driving the car (4) along the rails (3).

In the conventional ropeless linear motor elevator system, there is no emergency brake mechanism for braking the car in an emergency such as when the propulsion force abnormally decreases due to a fault or the like, so the safety of the system is not completely satisfactory. Therefore, the conventional ropeless linear motor elevator system which has inadequate safety is difficult to put into practical use.

SUMMARY OF THE INVENTION

Accordingly, one object of the present invention is to provide a ropeless linear motor elevator system free from the above discussed problem of the conventional design.

Another object of the present invention is to provide a ropeless linear motor elevator system provided with an emergency braking system.

Another object of the present invention is to provide a ropeless linear motor elevator system which can immediately stop the elevator car when the propulsion force is abnormally reduced.

With the above objects in view, the ropeless linear motor elevator system comprises a brake unit which comprises a brake shoe mounted on an elevator car. The brake shoe is engageable and disengageable with respect to a rail for maintaining a stopped position of the elevator car by friction between the rail and the brake shoe. The brake shoe is biased into engagement with the rail by a biasing member such as a spring. The system also comprises an operating member which, upon the generation of a propulsion force larger than a predetermined level on a linear motor propulsion body, moves upwardly together with the propulsion body with respect to the brake shoe, thereby separating the brake shoe from the rail against the biasing means.

An electromagnetic brake may be mounted on the elevator car to be electrically actuated for stopping the elevator car. Upon starting of the car, the electromagnetic brake is released, after the brake unit is released and upon the stopping of the car, the stopped position of the car is maintained by the brake unit after the car is stopped by the electromagnetic brake.

The ropeless linear motor elevator system of the present invention may comprise an elevator car, a rail for guiding the elevator car therealong, and linear motor coils disposed along the guide rail. A linear motor propulsion unit is mounted on the elevator car for generating a car propulsion force in cooperation with the linear motor armature coils, the propulsion unit having an operating bar movable relative to the elevator car. The elevator car has mounted thereon a brake unit including a brake shoe engageable with the rail to stop the elevator car and a biasing member for biasing the brake shoe toward the rail. The operating bar of the propulsion unit is movable between a first position in which the brake shoe engages the rail by the action of the biasing means and a second position in which the brake shoe is released from the rail against the action of the biasing means in response to a propulsion force acting on the propulsion unit.

BRIEF DESCRIPTION OF THE DRAWINGS

The present invention will become more readily apparent from the following detailed description of the preferred embodiment of the present invention considered in conjunction with the accompanying drawings, in which.

DESCRIPTION OF THE PREFERRED EMBODIMENT

Figure 1:
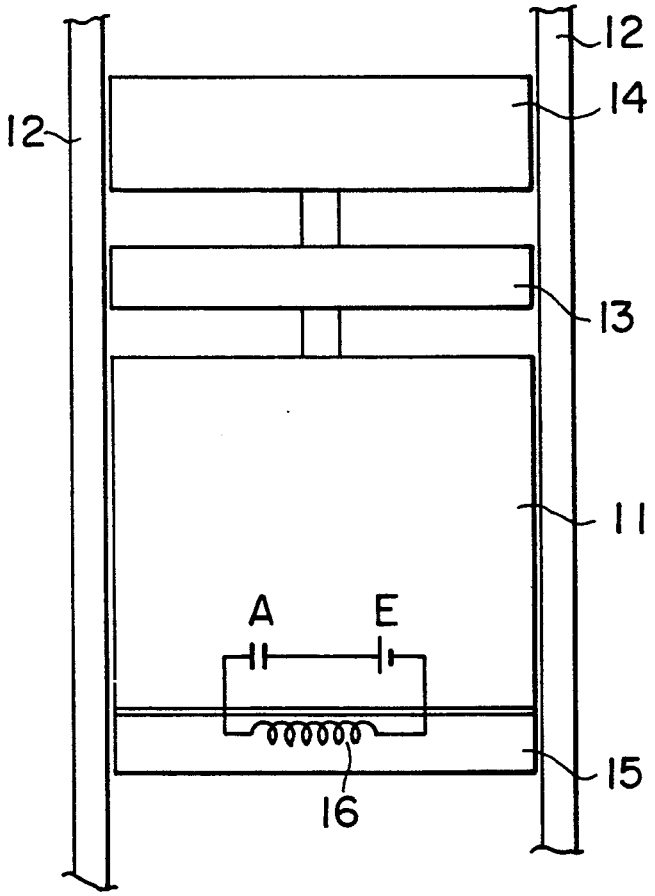
FIG. 1 is a schematic diagram illustrating a main portion of one embodiment of the present invention.

FIG. 1 illustrates the main portion of one embodiment of the ropeless linear motor elevator system of the present invention. In FIG. 1, an elevator car (11) vertically ascends and descends along guide rails (12) disposed within a hoistway. A propulsion member (14) is mounted on the upper portion of the elevator car (11) through a brake unit (13). The propulsion member (14) comprises permanent magnets (not shown) disposed in opposition to coils (not shown) disposed in the hoistway, so that the elevator car (11) is moved upwardly or downwardly by the propulsion force generated by a linear motor composed of the coils and the permanent magnets. The brake unit (13) is arranged to be actuated to brake the car (11) when a propulsion force is not acting on the propulsion member (14) and to release the brake when the propulsion force is being generated.

An electromagnetic brake (15) is mounted to the bottom portion of the elevator car (11). The electromagnetic brake (15) comprises an electromagnetic coil (16) which generates an electromagnetic force for releasing the brake. The electromagnetic coil (16) is connected to an electric power source (E) through contacts (A) through which the electromagnet coil (16) is energized when it is closed.

Figure 2:
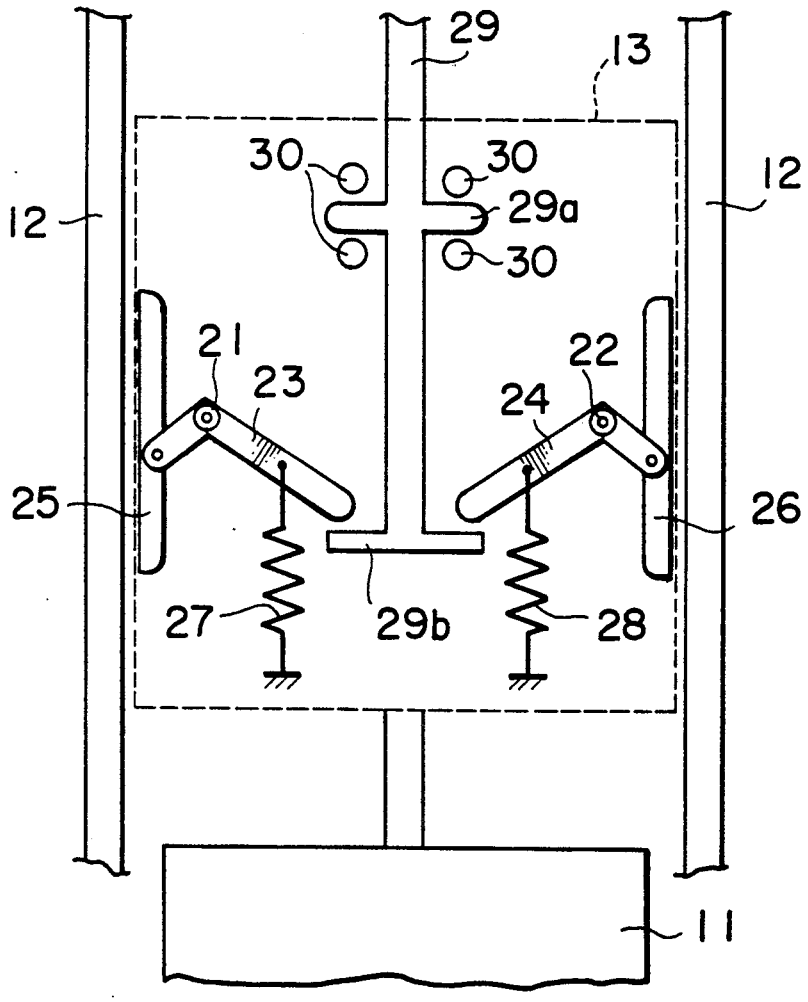
FIG. 2 is a schematic view of the brake unit illustrated in FIG. 1.

FIG. 2 illustrates the brake unit (13) of FIG. 1. In FIG. 2, the brake unit (13) comprises a first lever (23) and a second lever (24) rotatable about a first pivot (21) and a second pivot (22). One end of each of the levers (23) and (24)has mounted thereon a first brake shoe (25) and a second brake shoe (26), respectively, urged against the rails (12). The other end of each of the levers

(23) and (24) has mounted thereon a first spring (27) and a second spring (28) which are biasing means for biasing the levers (23) and (24) to urge the brake shoes (25) and (26) against the rails (12).

Extending from the propulsion body (14) into the brake unit (13) is an operating bar (29) which is an operating member. The operating bar (29) has laterally extending projections (29*a*) extending from its middle portion. Two bolts (30) are disposed on the brake unit (13) above and below the projections (29*a*), so that the range of the vertical movement of the operating bar (29) and the propulsion body (14) with respect to the brake unit (13) is limited.

The bottom end of the operating bar (29) has a first operating portion (29*b*) laterally extending therefrom. The first operating portion (29*b*) engage the levers (23) and (24) when the operating bar (29) moves upwardly relative to the brake unit (13) to rotate the levers (23) and (24) against the action of the springs (27) and (28) to move the brake shoes (25) and (26) away from the rails (12).

Figure 3:
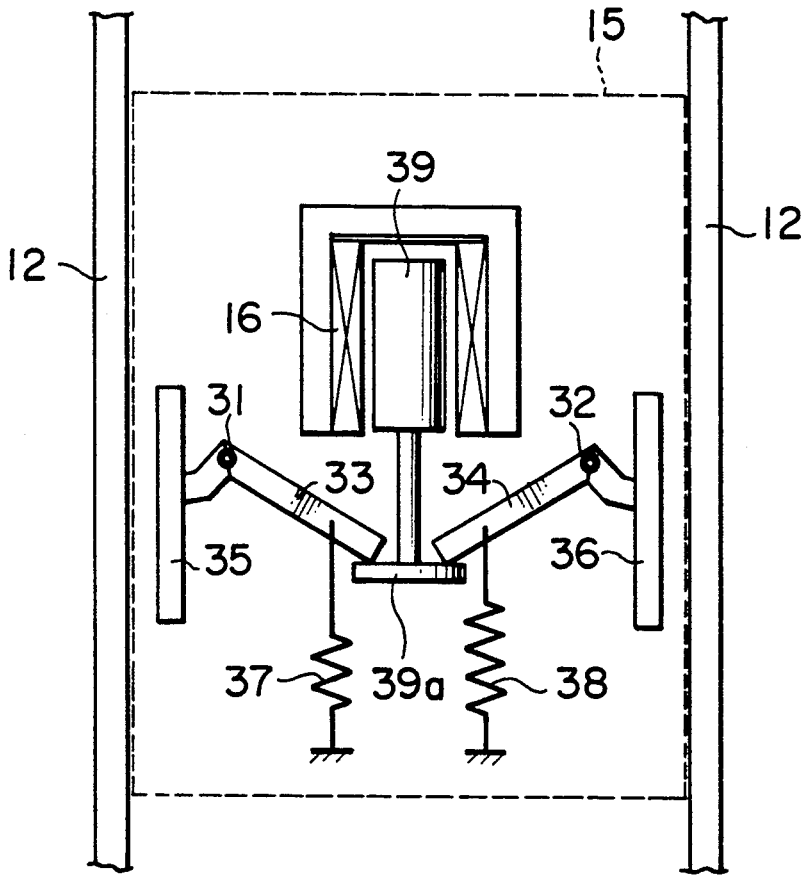
FIG. 3 is a schematic view of the electromagnetic brake illustrated in FIG. 1.
Figure 4:
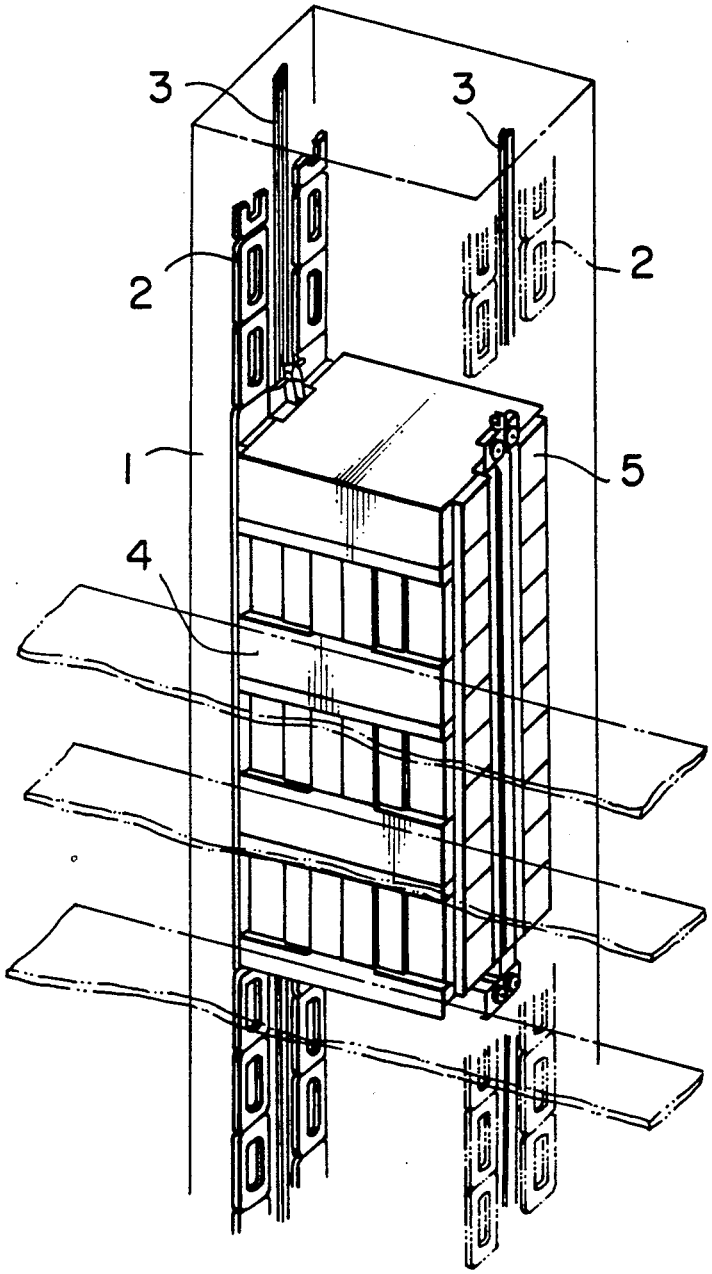
FIG. 4 is a schematic perspective view illustrating one example of a ropeless linear motor elevator system to which the present invention can be applied.

FIG. 3 illustrates the electromagnetic brake (15) of FIG. 1. In FIG. 3, the electromagnetic brake (15) comprises a third lever (33) and a fourth lever (34) rotatable about a third pivot (31) and a fourth pivot (32), respectively. One end of each of the levers (33) and (34) has mounted thereon a third brake shoe (35) and a fourth brake shoe (36) which can be urged against the rails (12). The other end of each of the levers (33) and (34) has mounted thereon a third spring (37) and a fourth spring (38) which bias the levers (33) and (34) to urge the brake shoes (35) and (36) against the rails (12).

Vertically movably disposed within the electromagnetic coil (16) is a plunger (39) which is moved up and downwardly by the electromagnetic force of the electromagnetic coil (16). The bottom end of the plunger (39) is provided with a laterally extending second operating portion (39*a*), which causes the levers (33) and (34) to rotate against the action of the springs (37) and (38) to move the brake shoes (35) and (36) away from the rails (12) when the plunger (39) is moved upwardly.

While the elevator car (11) is in a completely stopped position, no propulsion force is acting on the propulsion body (14), so the operating bar (29) is in its lowered position. Therefore, in the brake unit (13), the first and the second brake shoes (25) and (26) are urged against the rails (12) by the spring forces of the first and the second springs (27) and (28). Also, in the electromagnetic brake (15), since the contact (A) is opened and the electromagnetic coil (16) is not energized, the plunger (39) is in its lower position. Therefore, the third and fourth brake shoes (35) and (36) are urged against the rails (12) by the spring forces of the third and fourth springs (37) and (38). Because of the friction between each of the brake shoes (25), (26), (35) and (36) and the rails (12), the elevator car (11) is held in the stopped position.

When the elevator car (11) is to be started, the propulsion body (14) moves upward relative to the first brake unit (13) due to the propulsion force irrespective of the direction of travel of the car. More particularly, since the elevator car (11) is subject to gravitational force, the upward propulsion force acts on the propulsion body (14) while the car (11) is being moved upwardly or downwardly. Then, the operating bar (29) is moved upwardly together with the propulsion body (14) to release the first brake unit (13).

Thereafter, when the propulsion force increases and becomes equal to the weight of the elevator car (11), the contact (A) is closed to excite the electromagnetic coil (16). Then, the plunger (39) is pulled upwardly to release the electromagnetic brake (15), whereby the elevator car (11) can smoothly start to ascent or descend.

When the elevator car (11) approaches the target floor, the contact (A) is opened, whereby the elevator car (11) is stopped by the electromagnetic brake (15). Thereafter, the propulsion force of the propulsion body (14) is gradually decreased and the first brake unit (13) is activated to more reliably maintain the elevator car (11) in the stopped position.

When the propulsion force of the propulsion body (14) abnormally decreases for any reason, the brake unit (13) performs an emergency stop of the elevator car (11), so the elevator system has a much higher safety than the conventional design and can be easily put into practical use.

Also, since the electromagnetic brake (15) is released after the brake unit (13) is released upon starting, and the brake unit (13) is activated after the elevator car (11) is stopped by the electromagnetic brake (15) upon stopping, the safety mechanism gives the ropeless linear motor elevator system a safety similar to that of a rope-type elevator system. Also, by controlling the system as described above, a smooth starting and stopping of the elevator car as well as a comfortable ride can be realized.

Although the first and the second springs (27) and (28) are coil springs in the illustrated embodiment, they may be leaf springs. Also, while the propulsion body (14) for generating the propulsion force in the above embodiment is a separate member mounted above the elevator car (11), the propulsion body (14) may be integrally mounted on the side walls of the elevator car (11). Further, the linear motor is not limited to a synchronous motor but may be a linear induction motor. Also, the configuration of the operating bar (29) is not limited to that of the illustrated embodiment, and the electromagnetic brake (15) is not limited to that of the illustrated embodiment but may be of any structure as long as the elevator car (11) can be stopped.

What is claimed is:

1. A ropeless linear motor elevator system comprising a brake unit comprising:

a brake shoe mounted on an elevator car, said brake shoe being engageable and disengageable with respect to a rail for maintaining a stopped position of said elevator car by friction between said rail and said brake shoe;

biasing means for biasing said brake shoe into engagement with said rail; and an operating member which, upon the generation of a propulsion force larger than a predetermined level on a linear motor propulsion body, moves upwardly together with said propulsion body with respect to said brake shoe, thereby separating said brake shoe from said rail against said biasing means.

2. A ropeless linear motor elevator system comprising a brake unit comprising:

a brake shoe mounted on an elevator car, said brake shoe being engageable and disengageable with respect to a rail for maintaining a stopped position of said elevator car by friction between said rail and said brake shoe;

biasing means for biasing said brake shoe into engagement with said rail; and an operating member which, upon the generation of a propulsion force larger than a predetermined level on a linear motor propulsion body, moves upwardly together with said propulsion body with respect to said brake shoe, thereby separating said brake shoe from said rail against said biasing means; and an electromagnetic brake mounted on said elevator car and electrically actuated for stopping said elevator car, upon starting of said car, said electromagnetic being released after said brake unit is released and, upon the stopping of said car, the stopped position of said car being maintained by said brake unit after said car is stopped by said electromagnetic brake.

3. A ropeless linear motor elevator system comprising:

an elevator car;

a rail for guiding said elevator car therealong;

linear motor coils disposed along said rail;

a linear motor propulsion unit mounted on said elevator car for generating a car propulsion force in cooperation with said linear motor coils, said propulsion unit having an operating member movable relative to said elevator car;

a brake unit mounted to said elevator car and including a brake shoe engageable with said rail to stop said elevator car; and biasing means for biasing said brake shoe toward said rail, said operating member of said propulsion unit being movable between a first position in which said brake shoe engages said rail by the action of said biasing means and a second position in which said brake shoe is released from said rail against the action of said biasing means in response to a propulsion force acting on said propulsion unit.

* * * * *